United States Patent [19]

Coster

[11] Patent Number: 5,070,806

[45] Date of Patent: Dec. 10, 1991

[54] MARINE FUEL OVERFLOW DEVICE

[76] Inventor: Steven P. Coster, 954 Sevarden La., Crownsville, Md. 21032

[21] Appl. No.: 519,696

[22] Filed: May 7, 1990

Related U.S. Application Data

[63] Continuation-in-part of Ser. No. 335,302, Apr. 10, 1989, abandoned.

[51] Int. Cl.[5] ..... B63B 17/00; B65B 3/04

[52] U.S. Cl. ..... 114/343; 141/86; 141/311 A; 141/383; 220/573; 220/86.2; 222/108

[58] Field of Search ..... 141/86–88, 141/95–97, 14, 311 A, 382, 383; 137/312; 215/4; 220/86 R, 85 R, 85 S, 85 SP, 571, 573; 222/108, 109, 111, 572; 114/219, 343, 364; 294/27.1, 31.2; 440/88

[56] References Cited

U.S. PATENT DOCUMENTS

| | | | |
|---|---|---|---|
| Re. 32,458 | 7/1987 | DeLay, Jr. . | |
| 1,421,696 | 7/1922 | Kucera . | |
| 2,154,647 | 4/1939 | West . | |
| 2,719,655 | 10/1955 | Hellerbusch . | |
| 3,145,686 | 8/1964 | Blythe | 114/219 |
| 3,225,975 | 12/1965 | Hallerback . | |
| 3,988,997 | 11/1976 | Fenton | 114/219 |
| 4,082,125 | 4/1978 | Wilson et al. . | |
| 4,640,446 | 2/1987 | Walker . | |
| 4,702,290 | 10/1987 | Perez . | |
| 4,802,514 | 2/1989 | Morse . | |

*Primary Examiner*—Bryon P. Gehman
*Attorney, Agent, or Firm*—Henderson & Sturm

[57] ABSTRACT

A fuel overflow device (10) for marine motorcraft (100) having a fuel overflow tube (103) wherein the device (10) includes a receptacle member (20) equipped with a flexible tether (40) for suspending the receptacle member (20) from the superstructure of a boat (100) and a stabilizing unit (13) comprising a suction cup (50) adapted to releasably yet fixedly secure the receptacle member (20) beneath the outlet (103') of the fuel overflow tube (103) to collect the spilled fuel from the overflow tube (103).

5 Claims, 1 Drawing Sheet

FIG. 1.
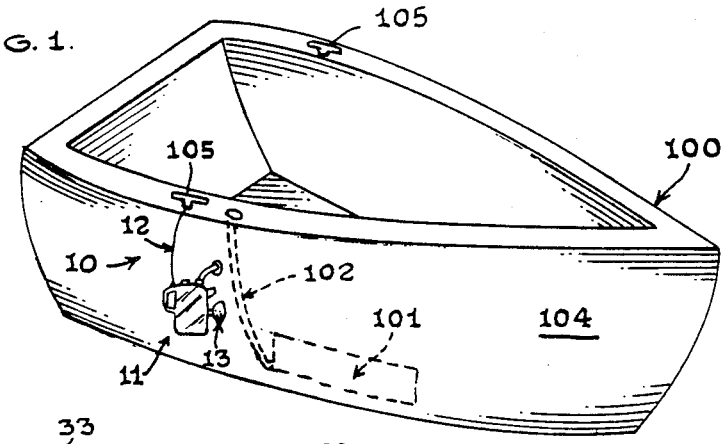
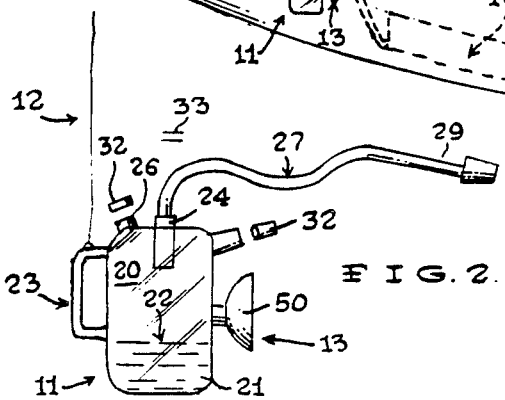
FIG. 2.
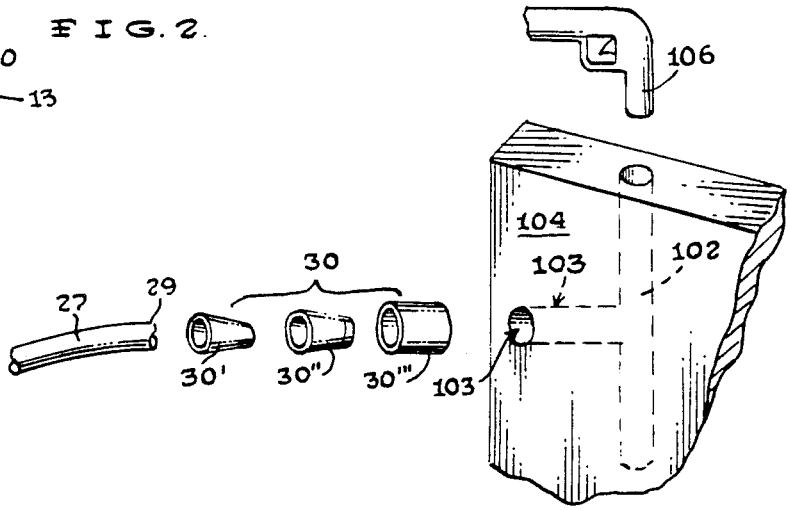
FIG. 3.
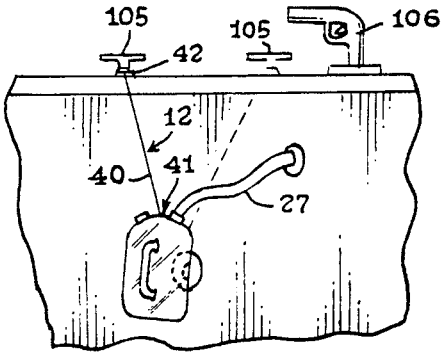
FIG. 4.

MARINE FUEL OVERFLOW DEVICE

BACKGROUND OF THE INVENTION

This application is a continuation-in-part application of patent application Ser. No. 07/335,302, filed on Apr. 10, 1989 and entitled MARINE FUEL OVERFLOW DEVICE now abandoned.

TECHNICAL FIELD

The present invention relates to pollution control devices in general, and more particularly to a marine environment fuel containment device.

As anyone who is familiar with marine activities is aware, this nation's rivers, streams, lakes and oceans represent a significant yet fragile portion of the environment; and, all steps necessary for the preservation of those natural resources not only should be taken but must be taken to preserve this natural heritage for the generations to come.

Given the large number of pleasure craft that ply our nation's waterways and given the growing environmental awareness that any reduction in the amount of pollutants that are inadvertently introduced into the marine environment will prolong and hopefully promote the recovery of these resources, pleasure boaters as a whole and power boaters in particular are eager to embrace any means available to preserve and protect the marine environment.

Most power boaters on an individual basis even if they exercise the utmost of care with the equipment available to date do inadvertently contribute to the fouling of the marine environment particularly in the act of fueling their craft.

Considering the fact that the vast majority of powered pleasure craft having built in fuel tanks are also equipped with an overflow tube that will allow a small amount of fuel to be expelled from the filling tube of the fuel tanks, to signal the operator of the fuel pump that both the fuel tank and the fill tube are approaching their maximum capacity and the expulsion of the small amount of fuel serves to avoid the spillage of significantly larger quantities of fuel into the environment, it is somewhat surprising that someone has not developed a simple and economical device that would intercept and retain the fuel that exits from the overflow tube to prevent even that small amount of fuel from polluting the environment.

Even granting the fact that on an individual basis a very small volume of marine fuel would normally be introduced into the surrounding water via the overflow tube, coupled with the fact that the lighter weight marine fuels quickly evaporate and do not pose a long term threat to the marine environment; when you consider the large number of times that this process is repeated, multiplied by the thousands upon thousands of boats potentially involved in this practice, these relatively insignificant individual amounts of fuel constitute a massive volume of one natural resource (e.g. fuel) being used to pollute another natural resource (e.g. the marine environment); and, obviously some positive steps must be taken to correct this practice.

SUMMARY OF THE INVENTION

Briefly stated, the marine fuel overflow device that forms the basis of the present invention involves a collection unit having a primary suspension unit and an auxiliary stabilizing unit which are adapted to cooperate with both top and the side of a motorcraft as well as the overflow and fill tubes associated with the internal fuel tanks of the motorcraft.

As will be explained in greater detail further on in the specification, the collection unit comprises in general: a receptacle member provided with a pouring spout portion wherein in one of the preferred embodiments of the invention the pouring spout portion is designed to cooperate with a hose member disposed intermediate the mouth of the receptacle member and the outlet of the fuel overflow tube.

Furthermore the primary suspension unit comprises at least one flexible tether member which is permanently attached on one end to the receptacle member and whose other end is adapted to releasably engage a portion of the superstructure of the boat such as a cleat or the like for suspending the receptacle member at a selected height relative to the fuel overflow outlet of the boat.

In addition, the auxiliary stabilizing unit comprises a releasable securing means that is operatively attached to the receptacle member and adapted to releasably engage a portion of a motorcraft in the vicinity of the overflow tube to stabilize the receptacle member at a location proximate to, and below the outlet of the overflow tube as fuel is being introduced into the filler tube of the internal fuel reservoir of the craft; such that the receptacle member cannot swing freely while suspended from the primary suspension unit.

BRIEF DESCRIPTION OF THE DRAWINGS

These and other objects, advantages and novel features of the invention will become apparent from the detailed description of the best mode for carrying out the preferred embodiment of the invention which follow; particularly when considered in conjunction with the accompanying drawings, wherein:

FIG. 1 is a perspective view of the preferred embodiment of the invention operatively engaged with a motorcraft;

FIG. 2 is a plan view of the invention;

FIG. 3 is an enlarged detail view of the cooperation between the filler hose, the various adaptor nozzles and the overflow tube; and, FIG. 4 is an isolated detail view of the invention suspended in the vicinity of the fuel overflow tube.

BEST MODE FOR CARRYING OUT THE INVENTION

As can be seen by reference to the drawings and in particular to FIG. 1, the marine fuel overflow device that forms the basis of the present invention is designed specifically for use with a motorcraft (100) having at least one internal fuel tank (101) equipped with a filler tube (102) having an overflow tube (103) which projects through the side (104) of the motorcraft (100) wherein the filler tube (102) is provided with a mouth that is dimensioned to receive a fuel nozzle (106) connected to a remote fuel source (not shown).

The fuel overflow device is designated generally by the reference numeral (10). The device (10) comprises in general: a fuel receptacle unit (11) a primary suspension unit (12) and an auxiliary stabilizing unit (13). These units will now be described in seriatim fashion.

In the preferred embodiment depicted in FIGS. 1 and 2, the fuel receptacle unit (11) comprises a generally transparent receptacle member (20) including a generally closed receptacle element (21) forming a fluid reservoir (22) and provided with a handle portion (23) a reduced diameter mouth opening (24) a nozzle element (25) and a one-way vent means (26).

In addition, the fuel receptacle unit (11) of the first version is further provided with a transparent filler hose (27) having one end (28) which is adapted to be slideably engaged in the mouth (24) of the receptacle member (20) and having the other end (29) which is adapted to be operatively engaged in the outlet (103') of the overflow tube (103) via adaptor nozzles (30) which are dimensioned to be frictionally engaged in different sized overflow outlets (103'), whereby a fluid tight seal will be created between the overflow tube (103) and the receptacle member (20).

Furthermore both the one way vent means (26) and the receptacle nozzle element (25) are optionally provided with closure elements (32); and, the mouth (24) of the receptacle member (20) may also be provided with a cap closure (33) so that all of the openings in the receptacle member (20) may be sealingly engaged if so desired.

Turning now to FIGS. 2 and 4, it can be seen that the primary suspension unit (12) comprises at least one elongated flexible tether member (40) having one end (41) which is permanently affixed to the receptacle member (20) and the other end (42) which is adapted to be releasably secured to a portion of the superstructure (104) of the boat (100) such as a cleat (105) which is disposed in proximity to the fuel tank filler tube (102).

As can be seen in FIG. 2 when only one flexible tether member (40) is attached to the boat superstructure (104) the receptacle member (20) can swing in a pendulum fashion in an arc of approximately 180° relative to the side of the boat (100); and, even when plural tether members (40) are employed, the receptacle member (20) is still capable of a pendulum motion generally perpendicular to the side of the boat (100).

In as much as any marine vessel (100) is in constant motion due to the action of the waves and people moving about on the edges of the deck particularly when the craft is being refueled, there is a very high probability that the filler hose (27) will become disengaged from either the mouth (24) of the receptacle member (20) or the mouth (103') of the overflow tube (103) due to the pendulum type suspension provided by the flexible tether members (40).

As a consequence of the foregoing situation and as shown in FIG. 2, this invention further contemplates the provision of an auxiliary stabilizing unit (13) for releasably securing the receptacle member (20) at a fixed location relative to the side of the boat. The auxiliary stabilizing unit (13) comprises a suction cup member (50) which projects outwardly from the side of the receptacle member (20); whereby, the receptacle member (20) will be temporarily restrained from movement relative to the side of the boat in a well recognized fashion.

By now it should be appreciated that when it is desired to fill the fuel tank (101) of a boat (100) with a fuel nozzle (106) the fuel nozzle is inserted into the fuel tank filler tube (102). At this point, the receptacle member (20) is suspended by the flexible tether member (40) at a location proximate to, and below, the level of the overflow tube outlet (103'); wherein, one end (28) of the filler hose (27) is inserted into the receptacle member (20); and, wherein the other end (29) of the filler hose (27) is fitted with the proper sized (30')(30'')(30''') adaptor nozzle (30) which will frictionally engage the overflow outlet (103').

The suction cup (50) is then forced into engagement with the side of the boat (100) to restrain the receptacle member (20) against lateral movement, and the filling process is then initiated. Once the fuel tank (101) is full, fuel will back up into the filler hose (102) and pass outwardly through the overflow tube outlet (103). At this juncture the fuel passing through the transparent filler hose (27) will give both an audible and visual signal to the fuel hose operator that the filling process has been completed.

It should also be appreciated by now that by employing the various closure elements (32) and (33) the fuel that is collected within the receptacle member (20) can be saved for a later time whereupon this fuel can be added to the fuel tank (101) by removing the cap closure (33) and the nozzle closure element (32) to pour the fuel into the filler tube (102).

Having thereby described the subject matter of this invention it should be apparent that many substitutions, modifications and variations of the invention are possible in light of the above teachings. It is therefore to be understood that the invention as taught and described herein is only to be limited to the extent of the breadth and scope of the appended claims.

I claim:

1. A fuel overflow device in combination with a marine motorcraft having a fuel system including an internal fuel tank equipped with a filler tube provided with an overflow tube projecting through the side of the motorcraft to prevent spilled fuel from contaminating the marine environment wherein the fuel overflow device consists of a receptacle unit including a receptacle member forming a fluid reservoir for the purpose of capturing, collecting, and reintroducing fuel spilled from the outlet of said overflow tube back into said filler tube of said motorcraft;

a primary suspension unit including at least one elongated flexible tether member secured on one end to the receptacle member and having its other end releasably engaged with the superstructure of said motorcraft for suspending the receptacle member at a location proximate to said overflow tube; and, an auxiliary stabilizing unit operatively associated with the receptacle unit and comprising a suction cup for releasably yet fixedly securing the receptacle member, proximate to, and below the outlet of said overflow tube.

2. The device as in claim 1; wherein, the primary suspension unit comprises a pair of elongated tether members.

3. The device as in claim 1 wherein the receptacle unit further comprises the receptacle member being generally closed and having a mouth opening and further provided with a closeable vent.

4. The device as in claim 3 wherein the generally closed receptacle member is further provided with a handle portion.

5. The device as in claim 1 wherein the receptacle unit further comprises:

a filler hose adapted to be operatively engaged on one end with the mouth of the receptacle member and dimensioned on the other end to accept an adaptor element to be engaged with the outlet of said overflow tube.

* * * * *